US005720579A

United States Patent [19]

Trangsrud

[11] Patent Number: 5,720,579

[45] Date of Patent: Feb. 24, 1998

[54] GROUND ANCHOR

[75] Inventor: Julian P. Trangsrud, Northfield, Minn.

[73] Assignee: Royal Anchor Systems, Inc., Stacy, Minn.

[21] Appl. No.: 611,691

[22] Filed: Mar. 6, 1996

[51] Int. Cl.[6] ..... E02B 3/06; E02D 5/80

[52] U.S. Cl. ..... 405/244; 52/155; 52/162; 405/259.1; 405/303

[58] Field of Search ..... 405/244, 303, 405/259.1; 52/153–167; 114/293, 294, 304, 310, 311; 248/530, 533, 545

[56] References Cited

U.S. PATENT DOCUMENTS

| | | | |
|---|---|---|---|
| 1,047,097 | 12/1912 | MacNab | 52/163 |
| 1,564,069 | 12/1925 | Hoovens . | |
| 2,712,864 | 7/1955 | Clevett . | |
| 2,892,518 | 6/1959 | Fiske . | |
| 3,888,057 | 6/1975 | Zubke . | |
| 4,096,673 | 6/1978 | Deike . | |
| 4,574,539 | 3/1986 | Deike . | |
| 4,688,360 | 8/1987 | Luong et al. . | |
| 4,727,693 | 3/1988 | Rockenfeller et al. . | |
| 4,993,870 | 2/1991 | Bridgewater . | |
| 5,050,355 | 9/1991 | Pildysh . | |
| 5,175,966 | 1/1993 | Remke et al. . | |
| 5,322,386 | 6/1994 | Trangsrud . | |
| 5,463,834 | 11/1995 | Krieger . | |

FOREIGN PATENT DOCUMENTS

| | | |
|---|---|---|
| 2055268 | 6/1971 | Germany . |

*Primary Examiner*—Dennis L. Taylor
*Attorney, Agent, or Firm*—Haugen & Nikolai, P.A.

[57] ABSTRACT

A ground anchor for use in securing a desired object adjacent the ground is described. The ground anchor consists of a one-piece unitary molded plastic body member having a reinforcing rod extending through a mid portion thereof. The ground anchor includes an annular shoulder surface to which a driving force is translated. A cable or other tie member links an embedded ground anchor to the desired object. The anchor is configured so that tension on the cable tends to rotate the anchor within the ground to increase the resistance against pulling out of the ground.

20 Claims, 2 Drawing Sheets

GROUND ANCHOR

BACKGROUND OF THE INVENTION

I. FIELD OF THE INVENTION

This invention relates generally to ground anchors that are embedded in the ground for securing, by means of a suitable tether, an object to ground. More particularly, this invention relates to an economical, simple ground anchor that is easily inserted into the ground and which resists extraction, making it ideally suited for securing an object interest that is subjected to extreme forces.

II. DISCUSSION OF THE PRIOR ART

Over the years continued refinements have been made to ground anchors. Typically, ground anchors are used to anchor an object of interest to the ground. For example, an object to be secured to the ground may include trees, boats, airplanes, tents, scaffolding, playground equipment, mobile homes, utility buildings, silage covers, or farm fencing.

The ground anchor is embedded into the ground and securely attached to the object of interest. Oftentimes, a cable is attached at one end to the ground anchor, and at the other end to the object of interest. Frequently, extreme forces are applied to the object of interest. These forces are translated through the cable, applying an upward force on the ground anchor. Hence, in order for the ground anchor to hold the object of interest in place, the ground anchor must be designed to resist this upward force.

A specific example will now be discussed illustrating the extreme forces sometimes encountered and further demonstrating a need for a simplistic, sturdy, ground anchor. Specifically, concrete mats are used for reducing erosion caused by running water streams, such as may be present in drainage ditches, culverts, irrigation channels, stream beds and the like. One such concrete mat is disclosed by Crow et al. in U.S. Pat. No. 4,375,928. These mats are exposed to the substantial forces of rushing water, and must be held together and maintained in position. Ground anchors are inserted at strategic points relative to the concrete mats and use cable or chain to join the ground anchors to the mats to prevent their migration.

The substantial forces of rushing water tend to apply shifting forces against the mats. The weight of the concrete mats together with the shifting forces cause significant forces to be applied to the cable linked to the ground anchor. The ground anchor must be of sturdy construction and designed to resist the tension applied to the cable, thereby remaining intact within the ground. Otherwise, the ground anchors will pull out of the ground or break, allowing drastic shifts in the concrete mats.

Ground anchors have been designed to rotate within the ground to thereby create an increased surface area, when an upward force is applied against the cable, so that the ground anchor does not easily pull out of the ground. The following patents describe a ground anchor that rotates within the ground responsive to an upward force applied to a connecting cable: Bridgewater, U.S. Pat. No. 4,993,870 (hereinafter the '870 patent); Rockenfeller et al., U.S. Pat. No. 4,727,693 (hereinafter the '693 patent); Deike, U.S. Pat. No. 4,096,673 (hereinafter the '673 patent); Luong et al., U.S. Pat. No. 4,688,360 (hereinafter the '360 patent); Trangsrud, U.S. Pat. No. 5,322,386 (hereinafter the '386 patent); Remke et al., U.S. Pat. No. 5,175,966 (hereinafter the '966 patent); Pildysh, U.S. Pat. No. 5,050,355 (hereinafter the '355 patent); and Zubke, U.S. Pat. No. 3,888,057 (hereinafter the '057 patent).

The ground anchors disclosed by the '966, '355, '693, '057, and '360 patents each disclose a central member and a barb member pivotally attached to the central member. Once embedded in the ground, these barb members are designed to pivot about the central member, when an upward force is applied against the central member. Depending upon the conditions of the soil, a force sufficient to pivot the barb member may bend the pivot axis, thereby making the ground anchor inoperable for its intended purpose.

The ground anchor disclosed in the '386 patent has one end of the central member angled, thereby serving as a barb when an upward force is applied against the central member. The ground anchor disclosed in the '386 patent also requires a metal plate mounted in a slot formed in the central member. Alternatively, the metal plate may be molded into the central body during the molding process. The metal plate includes an eyelet to which a tether is attached. The plate is required to avoid failure of the ground anchor when subjected to high tensile forces. In either embodiment, requiring an additional metal plate increases the materials and manufacturing costs to produce the ground anchor.

The ground anchors disclosed in the '673 and '870 patents do not require a metal plate. The ground anchor disclosed by these patents have a region of the central member to which a cable is attached. Depending upon the conditions of the soil, a force sufficient to pivot the central member may cause the region of the central member to which a tether is attached to break away from the central member, thereby making the ground anchor inoperable for its intended purpose.

Hence, a need exists for an economical, simple, sturdy ground anchor that is easily inserted into the ground and which resists extraction, making it ideally suitable for securing concrete erosion control mats in place in drainage ditches, creek bottoms and the like. The present invention overcomes these and other disadvantages of the prior art.

SUMMARY OF THE INVENTION

The present invention relates to a sturdy yet simple, low-cost ground anchor which may be easily inserted into the ground, yet resists extraction and does not require a metal tether plate. The ground anchor comprises a single, unitary, molded plastic body that includes a central cylindrical portion having opposed ends. One end of the central cylindrical portion tapers to a point and the other end has a concentrically disposed cylindrical stem longitudinally extending therefrom. The cylindrical stem is of a lesser diameter than that of the central cylindrical body portion, whereby the intersection of the stem with the cylindrical body portion defines an annular shoulder.

Extending perpendicularly from the central cylindrical section is a flat fin-like projection of generally triangular shape. The fin has a bore extending through it, providing a tie point which is adapted to receive a tether in the form of a cord, cable, solid rod, chain or rope therethrough. The ground anchor is preferably molded from a suitable polymer, such as a nylon reinforced polyethylene. However, other known plastics of suitable strength may also be used. A reinforcing rod constructed preferably of spring steel wire, is molded within the unitary body comprising the ground anchor, thereby reinforcing the central cylindrical body, cylindrical stem and fin.

When installing the ground anchor, the tether is first secured to the fin through the fin's bore. The cylindrical stem portion is then inserted into a hollow end cavity formed in the lower end of a rigid drive rod. The lower end of the rigid rod thus rests against the annular shoulder of the ground anchor and an edge of the fin. The annular shoulder and edge of the fin provides a surface against which a driving force may be applied. With the pointed end of the ground anchor against the ground, the ground anchor is pounded into the ground by hammering the upper end of the rigid drive rod.

of course, the depth to which the ground anchor must be driven is a function of the load to be constrained and the soil conditions of the ground into which the anchor is driven. Once the ground anchor has been driven to the desired depth, the rigid drive rod is removed from the ground and the tether is pulled upwards. As the tether is pulled upwards with a sufficient force, the ground anchor tends to rotate to a position perpendicular to the channel or hole formed by driving the ground anchor into the ground. The reinforcing rod provides added support to the fin, increasing the amount of force that can be applied to the tether without tearing through or breaking the fin.

Thus, it is accordingly a principle object of the present invention to provide an economical, simple, sturdy, ground anchor that is easily inserted into the ground and which resists extraction.

Another object of the present invention is to provide a one-piece ground anchor having a sturdy tie-down member.

Still another object of the present invention is to provide a low-cost ground anchor ideally suitable for securing concrete erosion control mats in place in drainage ditches, creek bottoms and the like.

These and other objects and advantages as well as these and other features of the present invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
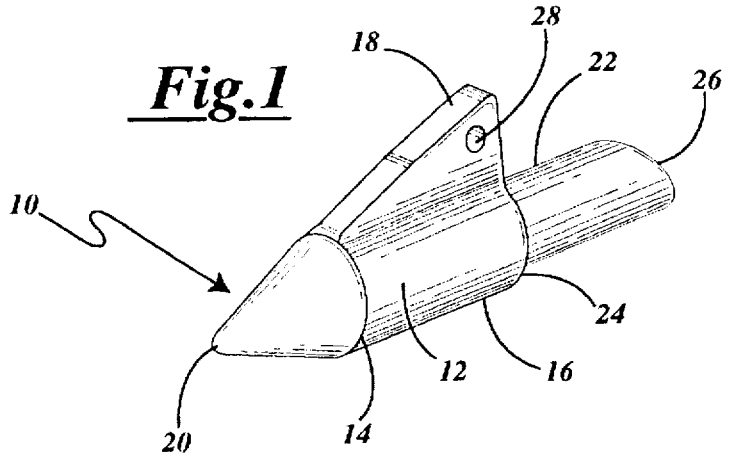
FIG. 1 is a perspective view of the ground anchor device of the present invention.
Figure 2:
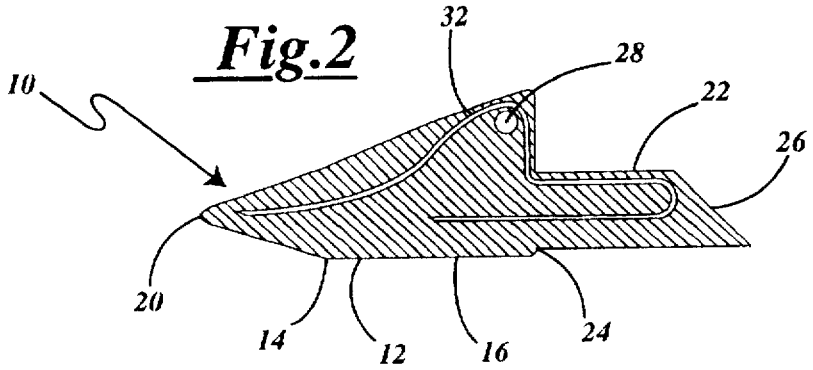
FIG. 2 is a sectional view of the ground anchor of the type shown in FIG. 1.

Referring first to FIGS. 1 and 2, there is indicated generally by numeral 10 the ground anchor in accordance with the present invention. The ground anchor 10 is a one-piece, unitary molded body, preferably molded from a nylon reinforced polyethylene polymer. Those skilled in the art will recognize that other suitable polymers of equal durability may be substituted.

The ground anchor 10 comprises a generally cylindrical central body portion 12 having opposed ends 14 and 16. The end 14 of the central cylindrical portion 12 tapers to a point 20. The other end 16 has a concentrically disposed cylindrical stem 22 longitudinally extending from the end 16. The cylindrical stem 22 is of a lesser diameter than that of the central cylindrical body 12, whereby the portion of the ground anchor 10 adjacent the stem 22 and central cylindrical body 12 defines an annular shoulder 24.

The free end of the stem 22 is angled at approximately 45° relative to the longitudinal axis of the ground anchor 10. The angled portion of the stem 22 forms a barb portion 26 (see FIG. 2) extending from the end of the stem 22. A portion of the ground anchor 10 extends perpendicularly outward from the central cylindrical body 12 thereby forming fin 18. The fin 18 has a bore 28 extending through the fin 18 from one side of the fin to the other to form an eyelet. In use, a tether 30 is threaded through the fin's bore 28 and fixedly attached thereto. The barb 26 tends to assist in rotating the ground anchor 10 within the ground when an upward force is applied on the ground anchor 10.

During the molding process, a reinforcing rod 32 is molded integrally within the ground anchor 10. The reinforcing rod 32 extends from the pointed end 20 into the central cylindrical body portion 12, and then upward into the fin 18. The reinforcing rod 32 extends through the fin 18, between the outer edge of the fin 18 and the bore 28 and back towards the central cylindrical body 12. From the central cylindrical body 12, the reinforcing rod extends into the stem 22 and curves 180° back into the central body 12, terminating therein. The reinforcing rod 32 is preferably constructed of a spring steel wire rod having an outer diameter ranging between 0.125 to 0.150 inches. The reinforcing rod 32 provides added strength to the fin 18, when extreme forces are applied against the ground anchor 10 through tether 30 to prevent tear-out of the material defining the bore 28.

Figure 3:
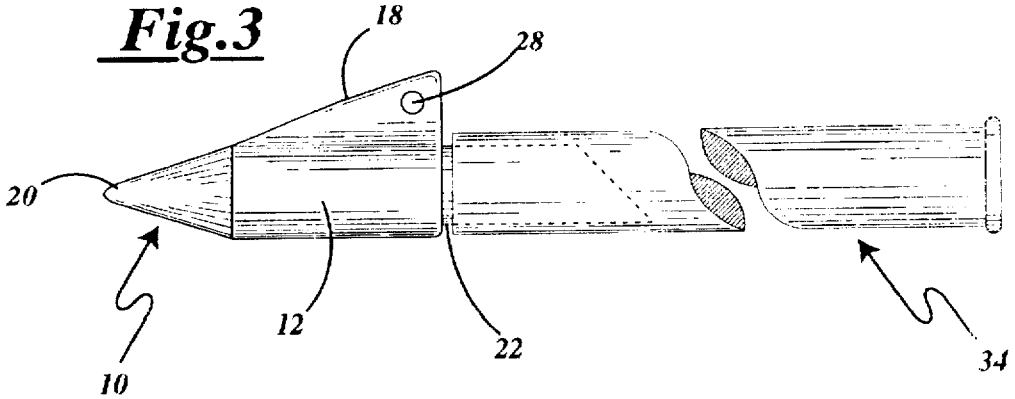
FIG. 3 is partial fragmentary a side elevational view of the ground anchor of the present invention inserted in a rigid drive rod.

Referring next to FIG. 3, the ground anchor 10 is shown inserted within a rigid drive rod 34. A cavity or socket 36 is formed in one end of the drive rod 34. The stem 22 of the ground anchor 10 is inserted into the socket 36. The inner diameter of the socket 36 is such that the end of the drive rod 34 abuts against the annular shoulder 24. When embedding the ground anchor 10 at a desired anchoring point within the ground 42, a driving force is applied to the free end of drive rod 34. The drive rod 34 pushes against the annular shoulder 24, translating the driving force to the ground anchor 10, driving its pointed end 20 deeper into the ground 42.

Figure 4:
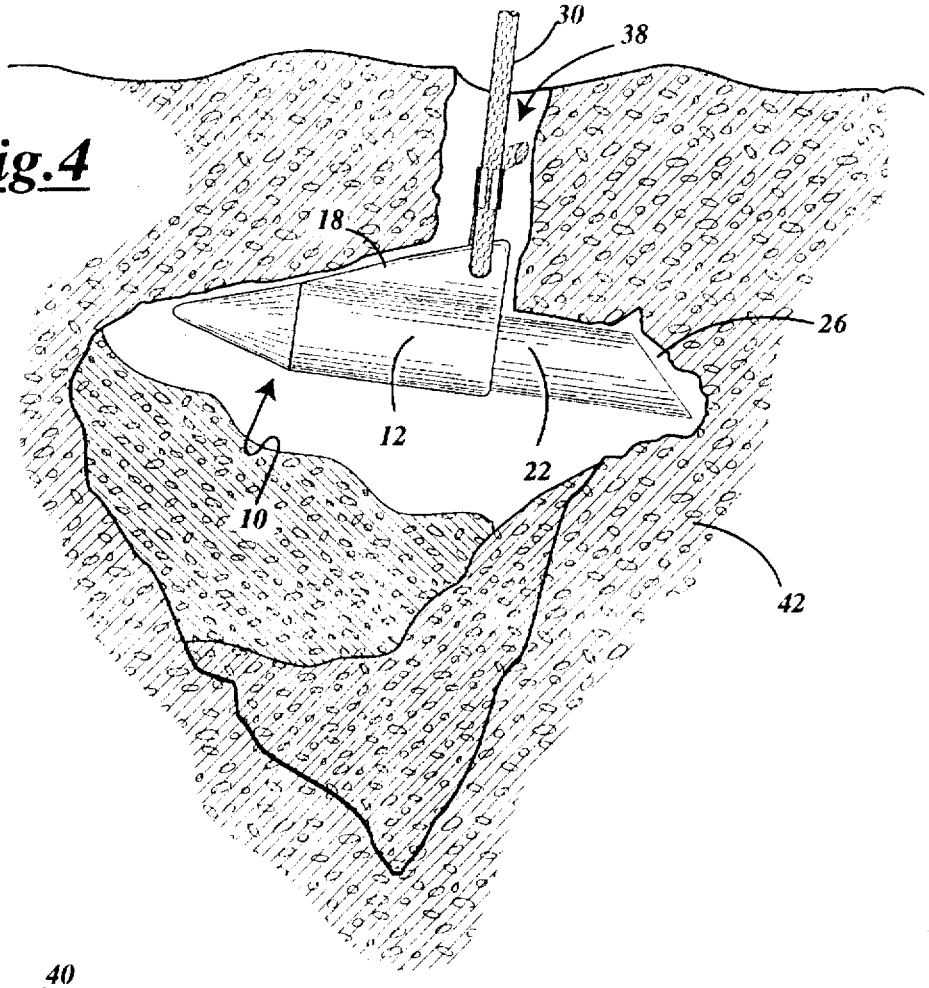
FIG. 4 is a partial fragmentary sectional view of the ground anchor inserted and rotated in the ground.

As the ground anchor 10 is driven into the ground 42, an entrance channel 38 is formed in the ground. Once the ground anchor 10 has been driven into the ground to the desired depth, the drive rod 34 is pulled out of the channel 38. As shown in FIG. 4, when an upward force is applied to the attached tether 30, the barb or beveled end 26 digs into a side of the channel 38, rotating the ground anchor 10 within the channel 38 until the ground anchor 10 is positioned generally perpendicular to the channel 38. This disposition of the ground anchor 10 increases the effective anchoring surface area of the anchor 10 relative to the ground, thereby making it more difficult for the anchor 10 to be pulled free.

Figure 5:
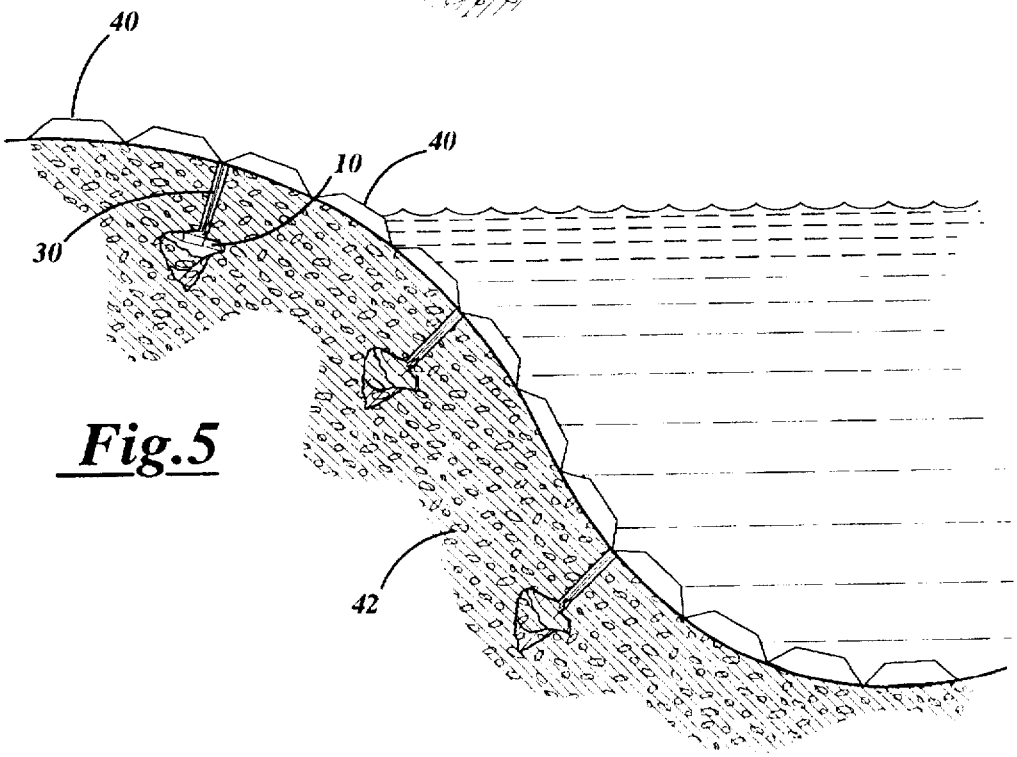
FIG. 5 is a partial fragmentary sectional view of several ground anchors embedded in the ground and attached to a concrete erosion control mat.

As indicated above, the ground anchor 10 is particularly useful in anchoring a concrete erosion control mat 40 in place in a drainage ditch, creek bed or the like. As previously recognized, the concrete mats 40 may be of the type described by Crow et al. in U.S. Pat. No. 4,375,928. Referring to FIG. 5, the concrete mats 40 are shown anchored to the ground by a plurality of ground anchors 10, to prevent the mats from shifting under the force of the water stream. A sturdy durable cord, of known construction, links the ground anchor 10 to the concrete mats 40. While the ground anchor 10 has been described primarily in its application for holding concrete erosion control mats 40 in place, those skilled in the art can appreciate that the ground anchor 10 of the present invention may be used for many different purposes, including tent stakes, anchors for tall towers or the like.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A ground anchor, for securing an object to the surface of the ground by means of a tether affixed to the ground anchor, said ground anchor comprising: a molded unitary member including a body having a central cylindrical portion with one end terminating in a point and an opposite end having a concentrically disposed cylindrical stem of a lesser diameter than that of said central cylindrical body portion longitudinally extending therefrom, to thereby define an annular shoulder adjacent said central cylindrical body portion and said cylindrical stem, said central cylindrical body further having a fin extending perpendicularly therefrom, wherein said fin includes a bore extending from one side of the fin to an opposite side of the fin; said molded unitary member further includes a reinforcing rod molded within a mid portion of said central cylindrical body, cylindrical stem, and said fin.

2. The ground anchor as in claim 1, wherein said central cylindrical portion, said fin and said cylindrical stem are formed from a polymer.

3. The ground anchor as in claim 2, wherein said polymer is a nylon filled polyethylene.

4. The ground anchor as recited in claim 1, wherein the reinforcing rod is a spring steel wire.

5. The ground anchor as in claim 1, wherein the free end of said stem is angled with respect to a longitudinal axis of said stem.

6. The ground anchor as in claim 5, wherein said central cylindrical portion, said fin and said cylindrical stem are formed from a polymer.

7. The ground anchor as in claim 6, wherein said polymer is a nylon filled polyethylene.

8. The ground anchor as recited in claim 7, wherein the reinforcing rod is a spring steel wire.

9. The ground anchor as in claim 1, wherein said fin is triangular in shape and the bore is located proximate an apex of said fin.

10. The ground anchor as recited in claim 1, wherein the reinforcing rod extends through said fin between an outer edge of said fin and the bore extending through said fin.

11. A ground anchor, for securing an object to the surface of the ground by means of a tether affixed to the ground anchor, comprising: a molded unitary member including a body having a central cylindrical portion with one end terminating in a point and an opposite end having a concentrically disposed cylindrical stem longitudinally extending therefrom, said central cylindrical body further having a fin extending perpendicularly therefrom, wherein said fin includes a bore extending from one side of the fin to an opposite side of the fin; said molded unitary member further includes a reinforcing rod molded within a mid portion of said central cylindrical body, cylindrical stem, and said fin.

12. The ground anchor as in claim 11, wherein said central cylindrical portion, said fin and said cylindrical stem are formed from a polymer.

13. The ground anchor as in claim 12, wherein said polymer is a nylon filled polyethylene.

14. The ground anchor as recited in claim 11, wherein the reinforcing rod is a spring steel wire.

15. The ground anchor as in claim 11, wherein the free end of said stem is angled with respect to a longitudinal axis of said stem.

16. The ground anchor as in claim 15, wherein said central cylindrical portion, said fin and said cylindrical stem are formed from a polymer.

17. The ground anchor as in claim 16, wherein said polymer is a nylon filled polyethylene.

18. The ground anchor as recited in claim 17, wherein the reinforcing rod is a spring steel wire.

19. The ground anchor as in claim 11, wherein said fin is triangular in shape and the bore is located proximate an apex of said fin.

20. The ground anchor as recited in claim 11, wherein the reinforcing rod extends through said fin between an outer edge of said fin and the bore extending through said fin.

* * * * *